United States Patent [19]

Mears

[11] Patent Number: 5,065,163

[45] Date of Patent: Nov. 12, 1991

[54] REUSABLE DEPLOYABLE ANTENNA

[75] Inventor: Arthur W. Mears, Berthoud, Colo.

[73] Assignee: Radarfind, Inc., Broomfield, Colo.

[21] Appl. No.: 569,560

[22] Filed: Aug. 20, 1990

[51] Int. Cl.[5] ..... H01Q 1/28

[52] U.S. Cl. ..... 343/706; 343/877

[58] Field of Search ..... 343/706, 877, 878, 848, 343/849; 244/33

[56] References Cited

U.S. PATENT DOCUMENTS

| | | | |
|---|---|---|---|
| 465,971 | 12/1891 | Edison | 423/64 |
| 1,296,687 | 3/1919 | Nichols | 343/706 |
| 1,540,998 | 6/1925 | Plauson | 343/706 |
| 1,650,461 | 11/1927 | Nilson | 343/706 |
| 2,380,587 | 7/1945 | Fenton | 116/124 |
| 2,392,199 | 1/1946 | Steiger | 244/98 |
| 2,470,783 | 5/1949 | Mead | 9/9 |
| 3,142,063 | 7/1964 | Goetzmann | 343/706 |
| 4,042,882 | 8/1977 | Camacho et al. | 325/118 |
| 4,305,140 | 12/1981 | Massa | 367/99 |
| 4,768,739 | 9/1988 | Schnee | 244/146 |

*Primary Examiner*—Rolf Hille
*Assistant Examiner*—Hoanganh Le
*Attorney, Agent, or Firm*—H. Kenneth Johnston, II

[57] ABSTRACT

A reusable portable device for providing location data by a lost individual as well as a signal enhancer for radios or other signal emitting devices. The device is in the form of a briefcase size unit containing a deflated airfoil with air brake and a gas cylinder containing lighter-than-air gas such as helium. The helium is released into the airfoil and is temporarily sealed with a clip. A signal emitting tether line attaches to the airfoil at one end and a reel at the other end. The reel contains a trim capacitor to adjust frequency of the antenna to different signal emitting devices which may be attached to the reel. Incorporated into the reel is a lightning arrestor which can be attached to an anchor permitting use in adverse weather. The reel may adjust the height of the airfoil and bring it back to the ground to be deflated and reused another time.

5 Claims, 3 Drawing Sheets

62
46

10
34
32

12
30
62
68
46
60
62
64
46
62
66
8
46
8
62

20
40
44
48

REUSABLE DEPLOYABLE ANTENNA

OBJECTIVE OF THE INVENTION

A broad objective of the invention is to provide a novel airfoil capable of being tethered by line and capable of emitting a signal generated on the ground by a signal device attached to the tether.

Another object of the invention is to provide a airfoil that will remain aloft in high winds.

Still another object of the invention is to provide an emergency locator device which can be used in all types of weather and from any place.

BACKGROUND OF THE INVENTION

There are various devices which are designed to permit the transmission of radio signals through the tether. Most devices are not reusable, are cumbersome or will not fly in high winds or no wind conditions. Schnee, U.S. Pat. No. 4,768,739 requires at least a light wind and has significant drawbacks in high winds as it would drag the individual. It claims the kite use as a sail. The Schnee device would be totally unusable in winds having velocity exceeding 20 miles per hour whereas the within invention will fly with wind velocity up to 80 miles per hour.

Massa, U.S. Pat. No. 4,305,140 shows a sonar device capable of being towed by a helicopter.

In Camacho, U.S. Pat. No. 4,042,882 a balloon is used to float a radio transmitter to a predetermined height, however, the operation is unable to send voice messages and the balloon is driven to the ground in high winds.

Thomas Edison in U.S. Pat. No. 465,971 suggests using a captive balloon for communicating from one point to another, however, the balloon is unable to withstand high winds as can the within invention.

Nilson, U.S. Pat. No. 1,650,461 suggests the use of a balloon with an antenna attached to a reel, however, the device of Nilson is bulky, not capable of being easily portable and will not remain aloft in high wind situations.

Nichols, U.S. Pat. No. 1,296,687 also suggests signaling from a captive balloon which has the same deficiencies as Nilson.

Although Goetzmann, U.S. Pat. No. 3,142,063 suggests a mobile balloon mounted antenna it is very bulky and will not stay aloft in high winds as will the present device.

In Steiger, U.S. Pat. No. 2,392,199 hazardous materials are used for gas generation which is unacceptable.

Both Mead U.S. Pat. No. 2,470,783 and Fenton U.S. Pat. No. 2,380,587 are limited in use to good weather and become inoperable under adverse weather.

In Mears, U.S. Pat. No. 4,800,835 the benefit of a small portable locator device has been seen and in Mears, U.S. Pat. No. 4,919,365 shows an improved maneuverable airfoil. The present invention is an improvement of both of these inventions.

DESCRIPTION OF THE PREFERRED EMBODIMENT

Figure 1:
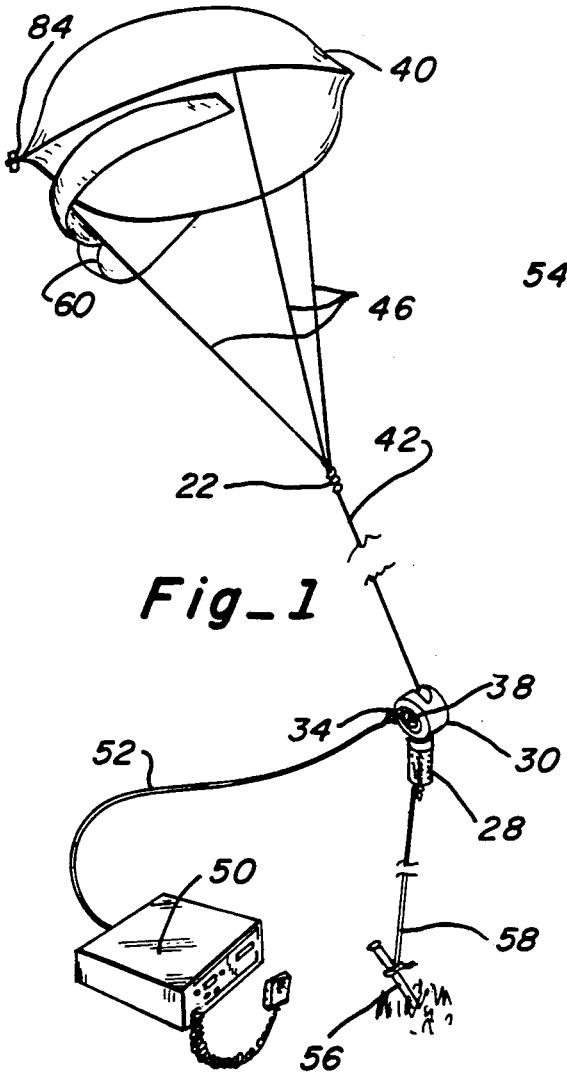
FIG. 1 is a perspective view of the device in the inflated state.
Figure 3:
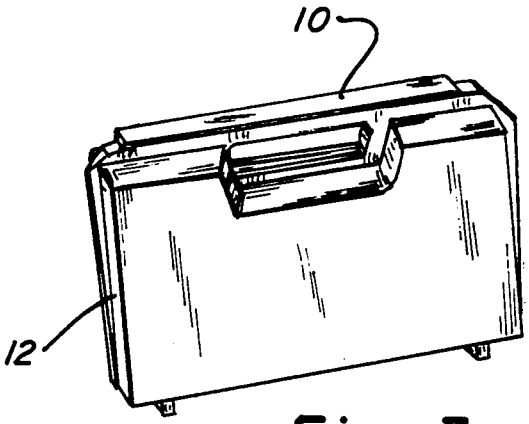
FIG. 3 is a perspective view of the carrying case of the device.
Figures 5, 7, 8:
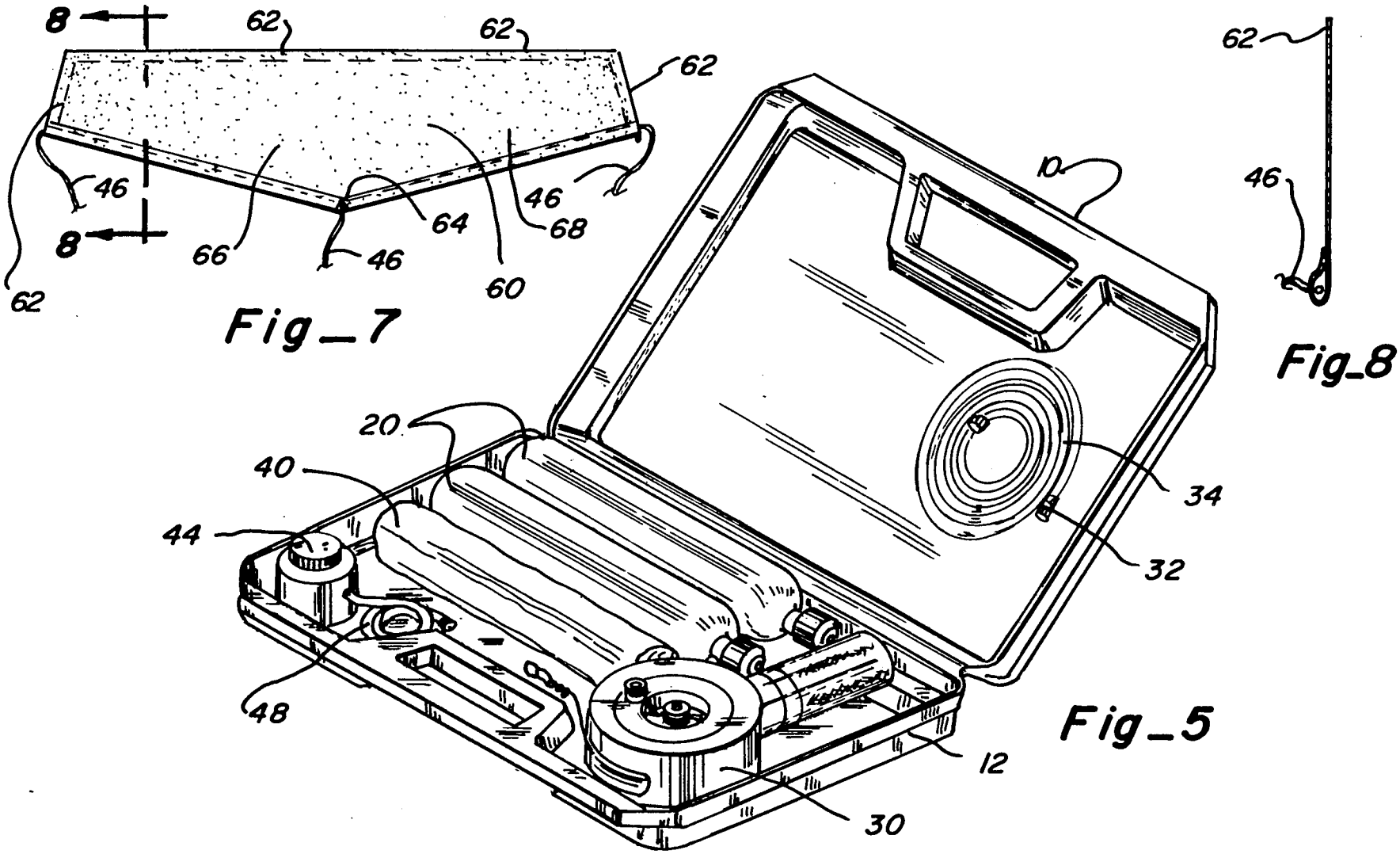
FIG. 5 is a perspective view of the locator device in the open carrying case.
FIG. 7 is a plan view of the speed brake.
FIG. 8 is a plan view of the speed brake taken along the lines 8—8.

Referring more particularly to the drawings, there is shown a reusable portable signal enhancer and locator device 10 in FIG. 1. As illustrated in FIGS. 3 and 5 the device 10 is easily portable in carrying case 12.

In operation puncture valve 44 is screwed onto compressed gas cylinder 20 puncturing compressed gas cylinder 20. Airfoil 40 is attached to fill tube 48 and the puncture valve 44 is opened transferring the gas in compressed gas cylinder 20 through puncture valve 44 and fill tube 48 in to airfoil 40. When airfoil 40 has been filled, airfoil 40 is removed from fill tube 48 and sealed with a quick clip 84 or other temporary device to seal airfoil 40.

Figure 4:
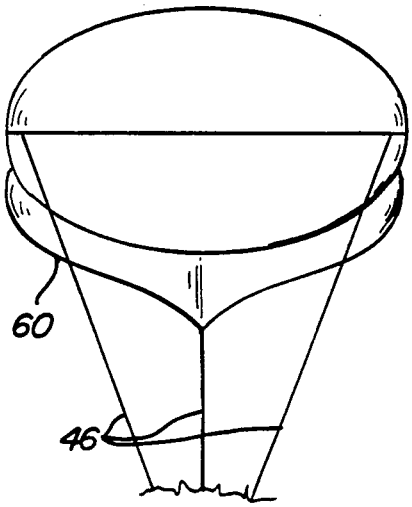
FIG. 4 is a front view of the airfoil.

Reinforcing line 78 is attached to air brake 60 to prevent the fabric from stretching as shown in FIGS. 7 and 8. Tethers 46 are attached to air brake 60 and airfoil 40 as shown in FIGS. 1 and 4 at one end and to swivel 22 at the other end. Swivel 22 is attached to the antenna tether 42 and may be extended or brought down by unwinding or winding the antenna tether 42 on reel 30 as shown in FIGS. 1 and 3 respectively.

Figure 2:
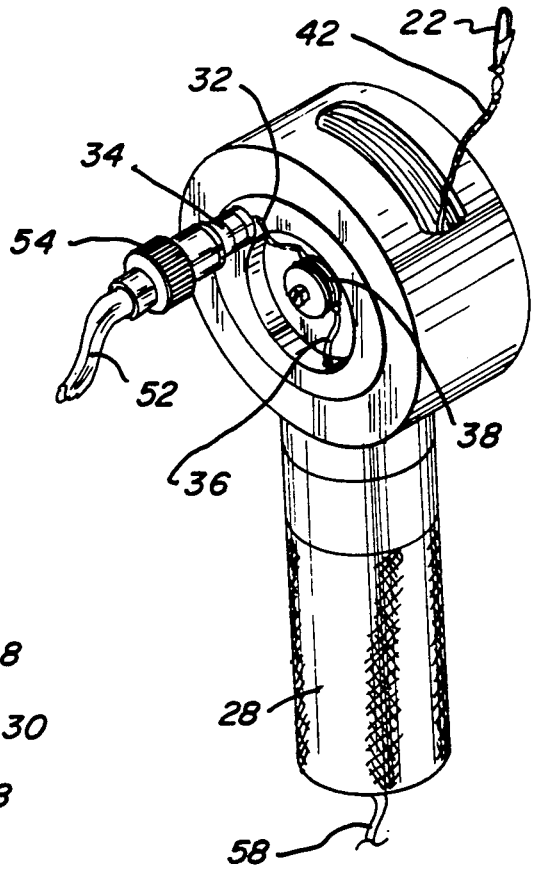
FIG. 2 is a perspective view of the reel.
Figure 6:
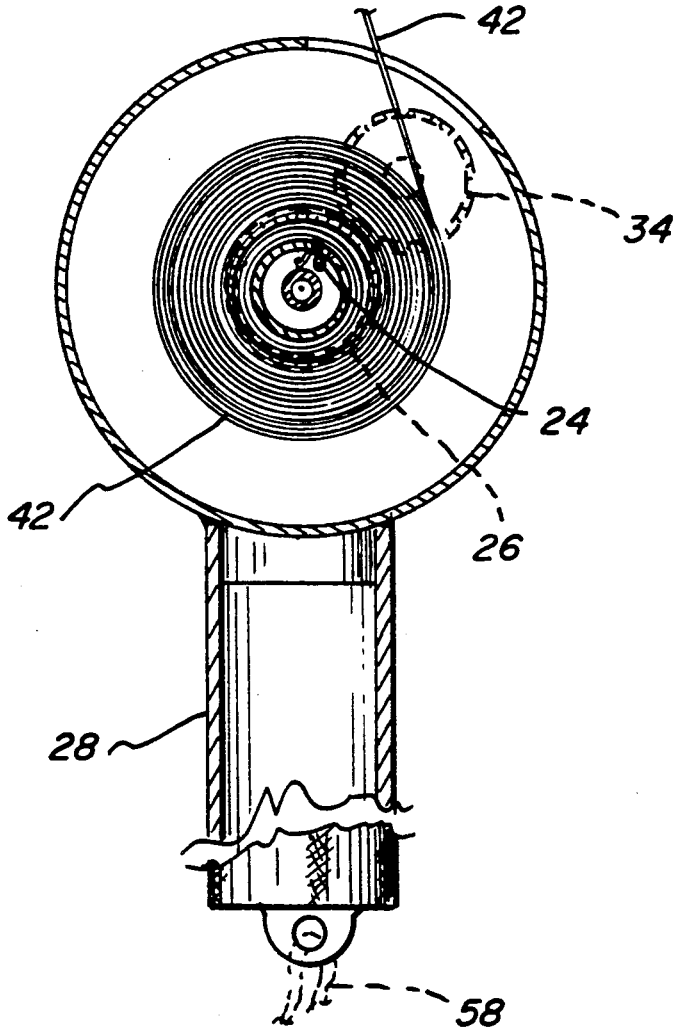
FIG. 6 is a cross-sectional view of the reel.

In operation, airfoil 40 is released, taking antenna tether 42 to substantially its full length. Reel 30 is then either held by handle 28 or is anchored with ground cable 58 and anchor rod 56 which may be driven into the ground or otherwise secured. Transmitter/receiver 50 is then connected to reel 30 with cable 52 by connector 54 being attached at connector crank 34 as shown in FIGS. 1 and 2. Connector crank 34 is connected to frequency adjustor 38 through wire 32. Frequency adjustor 38 can adjust the perspective length of antenna tether by several feet allowing the optimum antenna length to be maintained for transmission or reception purposes. Antenna tether 42 is secured to reel drum 26 to prevent it from escaping when antenna tether 42 is at its extended most position and antenna tether 42 passes through the reel 30 at port 24 and attaches to the frequency adjustor 38 as shown in FIG. 6. Frequency adjustor 38 is grounded by way of ground wire 36 through reel 30 to handle 28 and ground cable 58 and anchor rod 56.

Airfoil 40 is able to maintain its loft in calm winds due to the lighter-than-air gas used to inflate it. However, in strong winds, of hurricane velocity, airfoil 40 remains aloft above the transmitter area due to the air brake 60 which is securely affixed to airfoil 40.

Air brake 60 is made from a porous material allowing air to pass through it and yet providing adequate resistance to keep airfoil 40 aloft above the transmitter area.

The unassembled air brake 60 as shown in FIG. 7 has two substantially equal sides 66 and 68 respectively with the center of the air brake 60 being at center point 64. Air brake 60 is affixed to the airfoil 40 along adhesive strip 62. Although tether lines 46 are secured to air brake 60 and airfoil 40 by grommets, they may be secured by any other generally accepted means.

The invention and its attendant advantages will be understood from the foregoing description; and it will be apparent that various changes may be made in the form, construction and arrangement of the parts of the invention without departing from the spirit and scope thereof, or sacrificing its material advantages, the arrangements hereinbefore described being merely by way of example; and I do not wish to be restricted to the specific forms or uses mentioned, except as defined in the accompanying claims.

What is claimed is:

1. A reusable portable locating, transmitting and receiving device comprising:

A aerodynamically shaped airfoil capable of being repeatedly inflated with a lighter-than-air gas through a filler means and secured with a clip means preventing said lighter-than air gas from escaping through the filler means;

said airfoil having a top portion and a bottom portion;

said bottom portion having a air brake means affixed rearwardly and downwardly for providing lift in adverse weather said airfoil securely affixed to a swivel means by a tether means permitting said airfoil to automatically face into the wind;

a tether antenna means capable of emitting and receiving radio signals affixed to said swivel means and a reel means;

said reel means having a frequency adjustor means for electronically adjusting the length of said tether antenna means interconnected to said tether antenna means and rotatabley affixed to said tether antenna means through said reel means;

a signal emitting and receiving means connectively affixed to said tether antenna means through said reel means, said reel means having a ground means for simultaneously anchoring and grounding of said reusable, portable, locating, transmitting, and receiving device during use in adverse weather conditions and said reusable, portable, locating, transmitting, and receiving device in the deflated state may be transported in a carrying case.

2. A device according to claim 1 wherein said air brake means is a porous material permitting some air flow through said material.

3. A device according to claim 1 wherein said tether antenna means is a fabric wrapped metallic line capable of emitting and receiving radio signals.

4. A device according to claim 1 wherein said signal emitting and receiving means is a radio transmitter/-receiver.

5. A device according to claim 1 wherein said grounds means is a copper rod.

* * * * *